US010612106B2

(12) United States Patent
Gil Otin et al.

(10) Patent No.: US 10,612,106 B2
(45) Date of Patent: Apr. 7, 2020

(54) PROCESS FOR MANUFACTURING COLD-ROLLED AND ANNEALED STEEL SHEET WITH A VERY HIGH STRENGTH, AND SHEET THUS PRODUCED

(71) Applicant: ArcelorMittal, Luxembourg (LU)

(72) Inventors: Javier Gil Otin, Madrid (ES); Antoine Moulin, Woippy (FR)

(73) Assignee: ArcelorMittal, Luxembourg (LU)

( * ) Notice: Subject to any disclaimer, the term of this patent is extended or adjusted under 35 U.S.C. 154(b) by 401 days.

(21) Appl. No.: 15/243,610

(22) Filed: Aug. 22, 2016

(65) Prior Publication Data

US 2016/0355900 A1 Dec. 8, 2016

Related U.S. Application Data

(63) Continuation of application No. 12/599,166, filed as application No. PCT/FR2008/000609 on Apr. 28, 2008.

(30) Foreign Application Priority Data

May 11, 2007 (EP) ..... 07290598

(51) Int. Cl.

| | |
|---|---|
| ***C22C 38/02*** | (2006.01) |
| ***C21D 9/46*** | (2006.01) |
| ***C21D 8/02*** | (2006.01) |
| ***C22C 38/04*** | (2006.01) |
| ***C22C 38/06*** | (2006.01) |
| ***C22C 38/12*** | (2006.01) |
| ***C21D 9/52*** | (2006.01) |
| ***C23G 1/08*** | (2006.01) |
| ***B22D 11/00*** | (2006.01) |
| ***C22C 38/00*** | (2006.01) |
| ***C22C 38/14*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| ***C23G 1/00*** | (2006.01) |

(52) U.S. Cl.

CPC ..... *C21D 9/46* (2013.01); *B22D 11/001* (2013.01); *C21D 8/02* (2013.01); *C21D 8/0205* (2013.01); *C21D 8/0226* (2013.01); *C21D 8/0236* (2013.01); *C21D 9/52* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/28* (2013.01); *C22C 38/32* (2013.01); *C22C 38/38* (2013.01); *C23G 1/00* (2013.01); *C23G 1/08* (2013.01)

(58) Field of Classification Search

CPC ..... C21D 9/46; C22C 38/02

USPC ..... 148/546

See application file for complete search history.

(56) References Cited

U.S. PATENT DOCUMENTS

| | | | | |
|---|---|---|---|---|
| 5,695,576 | A | 12/1997 | Beguinot | |
| 6,254,698 | B1 | 7/2001 | Koo et al. | |
| 2005/0186654 | A1 | 8/2005 | Hara et al. | |
| 2006/0137768 | A1* | 6/2006 | Yuse | C22C 38/02 148/320 |
| 2006/0144483 | A1 | 7/2006 | Beguinot et al. | |
| 2009/0107588 | A1 | 4/2009 | Allain et al. | |

FOREIGN PATENT DOCUMENTS

| | | | |
|---|---|---|---|
| EP | 0725156 | A1 | 8/1996 |
| EP | 1306456 | A1 | 5/2003 |
| EP | 1559789 | A | 8/2005 |
| EP | 1559789 | A2 | 8/2005 |
| EP | 1559798 | A1 | 8/2005 |
| EP | 1589126 | A1 | 10/2005 |
| EP | 1676932 | A1 | 7/2006 |
| JP | H0925538 | A | 1/1997 |
| JP | H09263838 | A | 10/1997 |
| JP | H10280090 | A | 10/1998 |
| JP | 200080440 | A | 3/2000 |
| JP | 2001226741 | A | 8/2001 |
| JP | 2001267386 | A | 9/2001 |
| JP | 2004190050 | A | 7/2004 |
| JP | 2006070328 | A | 3/2006 |
| JP | 2006089775 | A | 4/2006 |
| JP | 2007177271 | A | 7/2007 |
| JP | 4304350 | B2 | 7/2009 |
| RU | 2235792 | C2 | 9/2004 |
| RU | 2292404 | C1 | 1/2007 |

OTHER PUBLICATIONS

Sugimoto et al., Retained Austenite Characteristics and Tensile Properties in a TRIP Type Bainitic Sheet Steel, ISIJ International, May 15, 2000, p. 902-908, vol. 40 (2000), No. 9.

Imose, Heating and Cooling Technology in the Continuous Annealing, Transactions ISIU, p. 911-932, vol. 25, 1985.

* cited by examiner

*Primary Examiner* — Weiping Zhu

(74) *Attorney, Agent, or Firm* — Davidson, Davidson & Kappel, LLC

(57) ABSTRACT

The present invention provides a cold-rolled and annealed steel sheet with a strength greater than 1200 MPa, the composition of which includes, the contents being expressed by weight: 0.10%≤C≤0.25%, 1%≤Mn≤3%, A≥0.010%, Si≤2.990%, S≤0.015%, P≤0.1%, N≤0.008%, it being understood that 1%≤Si+Al≤3%, it being understood that Cr+3Mo≥0.3%, Ti in an amount such that Ti/N≥4 and Ti≤0.040%. A balance of the composition includes iron and inevitable impurities resulting from the smelting. The microstructure of the steel includes 15 to 90% bainite, the remainder includes martensite and residual austenite.

7 Claims, 1 Drawing Sheet

Figure 1:
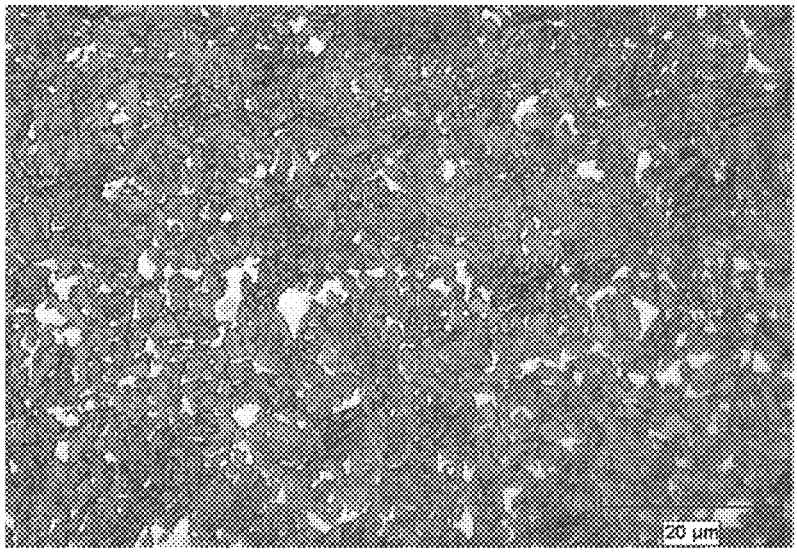

PROCESS FOR MANUFACTURING COLD-ROLLED AND ANNEALED STEEL SHEET WITH A VERY HIGH STRENGTH, AND SHEET THUS PRODUCED

This is a continuation application of U.S. application Ser. No. 12/599,166 filed Mar. 23, 2010, the entire disclosure of which is hereby incorporated by reference herein.

The invention relates to the manufacture of thin cold-rolled and annealed steel sheet having a strength greater than 1200 MPa and an elongation at break greater than 8%. The automotive sector and general industry particularly constitute fields of application of such steel sheet.

In the automotive industry in particular, there is a continual need to lighten vehicles and to increase safety. Various families of steels have been proposed in succession for meeting this increased strength requirement: firstly, steels have been proposed that contain microalloying elements. Their hardening is due to the precipitation of these elements and to the refinement of the grain size. There then followed the development of "dual-phase" steels in which the presence of martensite, a constituent of great hardness, within a softer ferrite matrix, allows a strength greater than 450 MPa associated with good cold formability to be obtained.

To increase the strength further, steels have been developed that have a "TRIP (Transformation Induced Plasticity)" behavior with combination of highly advantageous strength/deformability properties. These properties are attributed to the structure of such steels, which consists of a ferrite matrix containing bainite and residual austenite. The presence of the latter constituent gives an undeformed sheet a high ductility. Under the effect of subsequent deformation, for example uniaxial stresses, the residual austenite of a part made of TRIP steel is progressively transformed to martensite, thereby resulting in considerable consolidation and delaying the appearance of localized deformation.

Dual-phase or TRIP steel sheets have been proposed with a maximum strength level of the order to 1000 MPa. To achieve significantly higher strength levels, for example 1200-1400 MPa, various difficulties arise:

- the increase in mechanical strength requires a chemical composition containing considerably more alloying elements, to the detriment of the weldability of these steels;
- an increase in the hardness difference between the ferrite matrix and the hardening constituents is observed, this having the consequence that there is a local concentration of stresses and strains, and earlier damage, as witnessed by the lower elongation; and
- an increase in the fraction of hardening constituents within the ferrite matrix is also observed. In this case, the islands, which initially are isolated and small in size when the strength is low, become progressively connected and form large constituents that again promote early damage.

The possibilities of simultaneously obtaining very high strength levels and certain other usage properties by means of TRIP steels or steels with a dual-phase microstructure does seem to be limited. To achieve an even higher strength, that is to say a level above 800-1000 MPa, "multiphase" steels having a predominantly bainitic structure have been developed. In the automotive industry or in general industry, multiphase steel sheet of moderate thickness is used to advantage for structural parts such as fender cross-members, pillars and various reinforcements.

In particular in the field of cold-rolled multiphase steel sheet with a strength greater than 980 MPa, patent EP 1 559 798 discloses the manufacture of steels having the composition: 0.10-0.25% C; 1.0-2.0% Si; and 1.5-3% Mn, the microstructure consisting of at least 60% bainitic ferrite and at least 5% residual austenite, the polygonal ferrite being less than 20%. The exemplary embodiments presented in this document show that the strength does not exceed 1200 MPa.

Patent EP 1 589 126 also discloses the manufacture of thin cold-rolled sheet, the strength×elongation product of which is greater than 20000 MPa %. The composition of the steels contains: 0.10-0.28% C; 1.0-2.0% Si; 1-3% Mn; and less than 0.10% Nb. The structure consists of more than 50% bainitic ferrite, 5 to 20% residual austenite and less than 30% polygonal ferrite. Here again, the embodiments presented show that the strength is still less than 1200 MPa.

The object of the present invention is to solve the above-mentioned problems. Its aim is to provide a cold-rolled and annealed steel sheet having a strength greater than 1200 MPa together with an elongation at break greater than 8% and good cold formability. Another aim of the invention is to provide a steel that is largely insensitive to damage when being cut by a mechanical process.

Moreover, the aim of the invention is to provide a process for manufacturing thin sheet in which slight variations of the parameters do not result in substantial modifications to the microstructure or the mechanical properties.

The aim of the invention is also to provide a steel sheet that can be easily manufactured by cold rolling, that is to say the hardness of which after the hot-rolling step is limited in such a way that the rolling forces remain modest during the cold-rolling step.

The aim of the invention is also to provide a thin steel sheet suitable for the optional deposition of a metal coating using standard processes.

The aim of the invention is also to provide a steel sheet that is largely insensitive to damage by cutting and is capable of hole expansion.

The aim of the invention is also to provide a steel exhibiting good weldability by means of standard assembly processes such as spot resistance welding.

To achieve this, one subject of the invention is a cold-rolled and annealed steel sheet with a strength greater than 1200 MPa, the composition of which comprises, the contents being expressed by weight: $0.10\% \leq C \leq 0.25\%$, $1\% \leq Mn \leq 3\%$, $Al \geq 0.010\%$, $Si \leq 2.990\%$, $S \leq 0.015\%$, $P \leq 0.1\%$, $N \leq 0.008\%$, it being understood that $1\% \leq Si+Al \leq 3\%$, the composition optionally comprising: $0.05\% \leq V \leq 0.15\%$, $B \leq 0.005\%$, $Mo \leq 0.25\%$, $Cr \leq 1.65\%$, it being understood that $Cr+3Mo \geq 0.3\%$, Ti in an amount such that $Ti/N \geq 4$ and $Ti \leq 0.040\%$, the balance of the composition consisting of iron and inevitable impurities resulting from the smelting, the microstructure of said steel comprising 15 to 90% bainite, the remainder consisting of martensite and residual austenite.

Another subject of the invention is a steel sheet of the above composition, with an elongation at break greater than 10%, characterized in that $Mo < 0.005\%$, $Cr < 0.005\%$, $B = 0\%$, the microstructure of the steel comprising 65 to 90% bainite, the remainder consisting of islands of martensite and residual austenite.

Another subject of the invention is a steel sheet of the above composition, characterized in that it contains: $Mo \leq 0.25\%$, $Cr \leq 1.65\%$, it being understood that $Cr+3Mo \geq 0.3\%$, $B = 0\%$, the microstructure of the steel comprising 65 to 90% bainite, the remainder consisting of islands of martensite and residual austenite.

Yet another subject of the invention is a steel sheet of the above composition, with a strength greater than 1400 MPa and an elongation at break greater than 8%, characterized in that it contains: Mo≤0.25%, Cr≤1.65%, it being understood that Cr+3Mo≥0.3%, the microstructure of the steel comprising 45 to 65% bainite, the remainder consisting of islands of martensite and residual austenite.

Another subject of the invention is a steel sheet of the above composition, with a strength greater than 1600 MPa and an elongation at break greater than 8%, characterized in that it contains: Mo≤0.25%, Cr≤1.65%, it being understood that Cr+3Mo≥0.3%, the microstructure of the steel comprising 15 to 45% bainite, the remainder consisting of martensite and residual austenite.

According to one particular embodiment, the composition comprises: 0.19%≤C≤0.23%

According to a preferred embodiment, the composition comprises: 1.5%≤Mn≤2.5%

Preferably, the composition comprises: 1.2%≤Si≤1.8%

By way of preference, the composition comprises: 1.2%≤Al≤1.5% According to one particular embodiment, the composition comprises 0.05%≤V≤0.15% 0.004≤N≤0.008%.

Preferably, the composition comprises: 0.12%≤V≤0.15%

According to a preferred embodiment, the composition comprises: 0.0005≤B≤0.003%.

Preferably, the average size of the islands of martensite and residual austenite is less than 1 micron, the average distance between the islands being less than 6 microns.

Another subject of the invention is a process for manufacturing a cold-rolled steel sheet with a strength greater than 1200 MPa and an elongation at break greater than 10%, in which a steel is provided having a composition: 0.10%≤C≤0.25%; 1%≤Mn≤3%; Al ≥0.010%; Si≤2.990%, it being understood that 1%≤Si+Al≤3%; S≤0.015%; P≤0.1%; N≤0.008%; Mo<0.005%; Cr<0.005%; B=0, the composition optionally containing: 0.05%≤V≤0.15% and Ti in an amount such that Ti/N≥4 and that Ti≤0.040%. A semifinished product is cast from this steel; then the semifinished product is brought to a temperature greater than 1150° C. and the semifinished product is hot-rolled so as to obtain a hot-rolled sheet. The sheet is coiled and pickled; then the latter is cold-rolled with a reduction ratio of between 30 and 80% so as to obtain a cold-rolled sheet. The cold-rolled sheet is reheated at a rate $V_c$ between 5 and 15° C./s up to a temperature $T_1$ between Ac3 and Ac3+20° C., and held there for a time $t_1$ between 50 and 150 s, then the sheet is cooled at a rate $V_{R1}$ greater than 40° C./s but below 100° C./s down to a temperature $T_2$ between $B_s$ and ($M_s$−30° C. and $M_s$+30° C.). The sheet is maintained at said temperature $T_2$ for a time $t_2$ between 150 and 350 s and then it is cooled at a rate $V_{R2}$ of less than 30° C./s down to the ambient temperature.

Another subject of the invention is a process for manufacturing a cold-rolled steel sheet with a strength greater than 1200 MPa and an elongation at break greater than 8%, in which a steel is provided having a composition: 0.10%≤C≤0.25%; 1%≤Mn≤3%; Al≥0.010%; Si≤2.990%, it being understood that 1%≤Si+Al≤3%; S≤0.015%; P≤0.1%; N≤0.008%; Mo≤0.25%; Cr≤1.65%, it being understood that Cr+3Mo≥0.3%, optionally 0.05%≤V≤0.15%, B≤0.005% and Ti in an amount such that Ti/N≥4 and Ti≤0.040%. A semifinished product is cast from this steel; then the semifinished product is brought to a temperature greater than 1150° C.; then the semifinished product is hot-rolled so as to obtain a hot-rolled sheet. The sheet is coiled; then the latter is pickled; then the sheet is cold-rolled with a reduction ratio of between 30 and 80% so as to obtain a cold-rolled sheet. The cold-rolled sheet is reheated at a rate $V_c$ between 5 and 15° C./s up to a temperature $T_1$ between Ac3 and Ac3+20° C., and held there for a time $t_1$ between 50 and 150 s, then the latter is cooled at a rate $V_{R1}$ greater than 25° C./s but below 100° C./s down to a temperature $T_2$ between $B_s$, and ($M_s$−20° C.). The sheet is maintained at the temperature $T_2$ for a time $t_2$ between 150 and 350 s and then it is cooled at a rate $V_R$ of less than 30° C./s down to the ambient temperature.

The temperature $T_1$ is preferably between Ac 3+10° C. and Ac3+20° C.

Another subject of the invention is the use of a cold-rolled and annealed steel sheet according to one of the above embodiments, or manufactured by a process according to one of the above embodiments, for the manufacture of structural parts or reinforcing elements in the automotive field.

Figure 2:
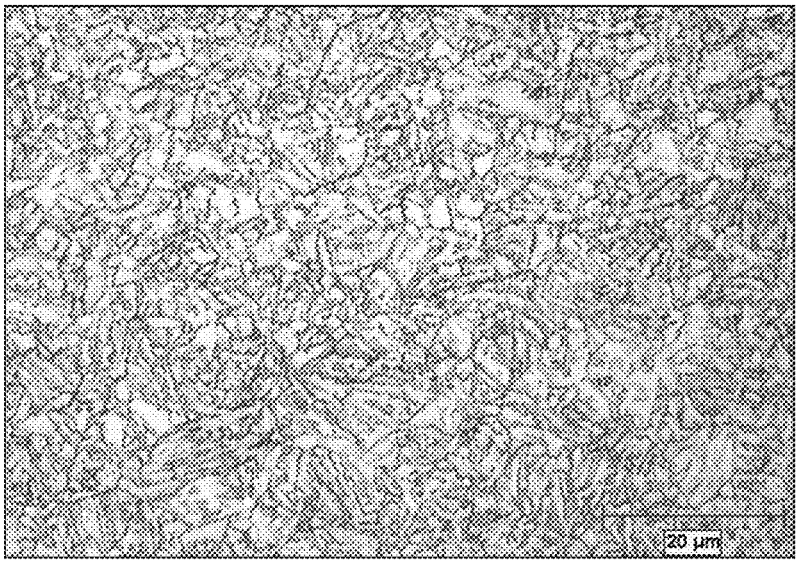

Other features and advantages of the invention will become apparent over the course of the description below, given by way of example and with reference to the figures appended hereto:

FIG. 1 shows an example of the structure of a steel sheet according to the invention, the structure being revealed by the LePera etchant; and FIG. 2 shows an example of the structure of a steel sheet according to the invention, the structure being revealed by the Nital etchant.

The inventors have demonstrated that the above problems are solved when the cold-rolled and annealed thin steel sheet has a bainitic microstructure, complemented with islands of martensite and residual austenite, or "M-A" islands. In the case of steels with the highest strength, greater than 1600 MPa, the microstructure includes a larger amount of martensite and residual austenite.

As regards the chemical composition of the steel, carbon plays a very important role in the formation of the microstructure and in the mechanical properties: in conjunction with other elements (Cr, Mo, Mn) of the composition and with the annealing heat treatment after cold rolling, carbon increases the hardenability and makes it possible to obtain a bainitic transformation. The carbon contents according to the invention also result in the formation of islands of martensite and residual austenite, the quantity, the morphology and the composition of which enable the above-mentioned properties to be obtained.

Carbon also retards the formation of proeutectoid ferrite after the annealing heat treatment following the cold rolling: otherwise, the presence of this low-hardness phase would result in excessively large amounts of local damage at the interface with the matrix, the hardness of which is higher. To achieve high strength levels, the presence of proeutectoid ferrite resulting from the annealing must therefore be avoided.

According to the invention, the carbon content is between 0.10 and 0.25% by weight. Below 0.10%, sufficient strength cannot be obtained and the stability of the residual austenite is unsatisfactory. Above 0.25%, the weldability is reduced because of the formation of quench microstructures in the heat-affected zone.

According to a preferred embodiment, the carbon content is between 0.19 and 0.23%. Within this range, the weldability is very satisfactory and the quantity, the stability and the morphology of the M-A islands are particularly suitable for obtaining a favorable pair of mechanical properties, namely strength/elongation.

In an amount between 1 and 3% by weight, an addition of manganese, which is an element promoting formation of the gamma-phase, prevents the formation of proeutectoid ferrite upon cooling after the annealing that follows the cold rolling. Manganese also contributes to deoxidizing the steel during smelting in the liquid phase. The addition of manganese also contributes to effective solid-solution hardening and to the achievement of a higher strength. Preferably, the manganese content is between 1.5 and 2.5% so that its effects are obtained, but without the risk of forming a deleterious banded structure.

According to the invention, silicon and aluminum together play an important role.

Silicon delays the precipitation of cementite upon cooling down from austenite after annealing. An addition of silicon according to the invention therefore helps to stabilize a sufficient amount of residual austenite in the form of islands, which subsequently and progressively are transformed to martensite under the effect of a deformation. Another portion of the austenite is transformed directly to martensite upon cooling after annealing.

Aluminum is a very effective element for deoxidizing the steel. In this regard, its content is equal to or greater than 0.010%. Like silicon, it stabilizes the residual austenite.

The effects of aluminum and silicon on the stabilization of the austenite are similar. When the silicon and aluminum contents are such that $1\% \leq Si+Al \leq 3\%$, satisfactory stabilization of the austenite is obtained, thereby making it possible to form the desired microstructures while still maintaining satisfactory usage properties. As the minimum aluminum content is 0.010%, the silicon content does not exceed 2.990%.

Preferably, the silicon content is between 1.2 and 1.8% for stabilizing a sufficient amount of residual austenite and to prevent integranular oxidation during the hot-coiling step that precedes the cold rolling. In this way, the formation of highly adherent oxides is avoided, as is any appearance of surface defects that would result in particular in a lack of wettability in hot-dip galvanizing operations.

These effects are also obtained when the aluminum content is preferably between 1.2 and 1.8%. For an equivalent content, the effects of the aluminum are similar to those explained above in the case of silicon, but the risk of surface defects appearing is however less.

The steels according to the invention optionally contain molybdenum and/or chromium. Molybdenum increases the hardenability, prevents the formation of proeutectoid ferrite and effectively refines the bainitic microstructure. However, a content greater than 0.25% by weight increases the risk of forming a predominantly martensitic microstructure to the detriment of the formation of bainite.

Chromium also contributes to preventing the formation of proeutectoid ferrite and to the refinement of the bainitic microstructure. Above 1.65%, the risk of obtaining a predominantly martensitic structure is high.

Compared with molybdenum, its effect is however less pronounced. According to the invention, the chromium and molybdenum contents are such that $Cr+3Mo \geq 0.3\%$.

The chromium and molybdenum factors in this relationship reflect their influence on the hardenability, in particular the respective capability of these elements to prevent the formation of proeutectoid ferrite under the particular cooling conditions of the invention.

According to an economic embodiment of the invention, the steel may have very low or zero molybdenum and chromium contents, that is to say contents below 0.005% by weight for these two elements, and 0% boron.

To obtain a strength greater than 1400 MPa, it is necessary to add chromium and/or molybdenum in the amounts mentioned above.

When the sulfur content is greater than 0.015%, the formability is reduced because of the excessive presence of manganese sulfides.

The phosphorus content is limited to 0.1% so as to maintain a sufficient hot ductility.

The nitrogen content is limited to 0.008% so as to avoid any ageing.

The steel according to the invention optionally contains vanadium in an amount between 0.05 and 0.15%. In particular when at the same time the nitrogen content is between 0.004 and 0.008%, precipitation of the vanadium in the form of fine carbonitrides may occur during the annealing that follows cold rolling, these carbonitrides providing additional hardening.

When the vanadium content is between 0.12 and 0.15% by weight, the uniform elongation or the elongation at break is particularly increased.

The steel may optionally contain boron in an amount not exceeding 0.005%. In a preferred embodiment, the steel preferably contains between 0.0005 and 0.003% boron, thereby helping to suppress the proeutectoid ferrite in the presence of chromium and/or molybdenum. As a complement to the other addition elements, boron, added in the amount mentioned above, makes it possible to obtain a strength greater than 1400 MPa.

The steel may optionally contain titanium in an amount such that $Ti/N \geq 4$ and $Ti \leq 0.040\%$. This enables titanium carbonitrides to be formed and increases the hardening.

The balance of the composition consists of inevitable impurities resulting from the smelting. The contents of these impurities, such as Sn, Sb and As, are less than 0.005%.

According to one embodiment of the invention intended for the manufacture of steel sheet with a strength greater than 1200 MPa, the microstructure of the steel is composed of 65 to 90% bainite, these contents referring to percentages per unit area, the remainder consisting of islands of martensite and residual austenite (islands of M-A compounds).

This structure is predominantly bainitic, containing no low-hardness proeutectoid ferrite, and has an elongation at break greater than 10%.

According to the invention, the M-A islands uniformly dispersed in the matrix have an average size of less than 1 micron.

FIG. 1 shows an example of the microstructure of a steel sheet according to the invention. The morphology of the M-A islands was revealed by means of appropriate chemical etchants: after etching, the M-A islands appear as white on a relatively dark bainite matrix. Some of the small islands are localized between the bainitic ferrite laths. The islands are observed at magnifications ranging from about 500× to 1500× on a statistically representative area and the average size of the islands and the average distance between these islands are measured using image analysis software. In the case of FIG. 1, the percentage of islands per unit area is 12% and the average size of the M-A islands is less than 1 micron.

It has been demonstrated that a specific morphology of the M-A islands is particularly desirable: when the average size of the islands is less than 1 micron and when the average distance between these islands is less than 6 microns, the following effects are obtained simultaneously:

- limited damage owing to the absence of fracture initiation on large M-A islands; and
- significant hardening owing to the proximity of many small M-A constituents.

According to another embodiment of the invention, intended for the manufacture of steel sheet with a strength greater than 1400 MPa and an elongation at break greater than 8%, the microstructure is composed of 45 to 65% bainite, the remainder consisting of islands of martensite and residual austenite.

According to another embodiment of the invention intended for the manufacture of steel sheet with a strength greater than 1600 MPa and an elongation at break greater than 8%, the microstructure is composed of 15 to 45% bainite, the remainder consisting of martensite and residual austenite.

The implementation of the process for manufacturing a thin cold-rolled and annealed sheet according to the invention is the following:

a steel of a composition according to the invention is provided;

a semifinished product is cast from this steel.

The casting may be carried out to form ingots or continuously to form slabs with a thickness of around 200 mm. The casting may also be carried out to form thin slabs with a thickness of a few tens of millimeters, or to form thin strip between steel counter-rotating rolls. The cast semifinished products are firstly heated to a temperature above 1150° C. so as to achieve, at all points, a temperature favorable for the high deformation that the steel undergoes during rolling. Of course, in the case of direct casting of thin slabs or thin strip between counter-rotating rolls, the step of hot rolling these semifinished products starting at most at 1150° C. may be carried out directly after casting, so that an intermediate reheating step is in this case unnecessary;

the semifinished product is hot-rolled. One advantage of the invention is that the final characteristics and the microstructure of the cold-rolled and annealed sheet are relatively independent of the end-of-rolling temperature and of the cooling following the hot rolling;

next, the hot-rolled sheet is coiled. The coiling temperature is preferably below 550° C. so as to limit the hardness of the hot-rolled sheet and the intergranular surface oxidation. Too high a hardness of the hot-rolled sheet results in excessive forces during subsequent cold rolling and possibly also edge defects;

next, the hot-rolled sheet is pickled using a process known per se so as to give it a surface finish suitable for the cold rolling.

The latter is carried out so as to reduce the thickness of the hot-rolled sheet by 30 to 80%;

next, an annealing heat treatment is carried out, preferably by continuous annealing, which comprises the following phases:

a heating phase with a heating rate $V_c$ of between 5 and 15° C./s up to a temperature $T_1$. When $V_c$ is greater than 15° C./s, the recrystallization of the sheet work-hardened by the cold rolling may not be complete. A minimum value of 5° C./s is required for the productivity. A rate $V_c$ of between 5 and 15° C./s makes it possible to obtain an austenite grain size particularly suitable for the desired final microstructure. The temperature $T_1$ is between Ac3 and Ac3+20° C., the temperature Ac3 corresponding to complete transformation to austenite during the heating. Ac3 depends on the composition of the steel and on the heating rate, and may for example be determined by dilatometry. Complete austenitization means that the subsequent formation of proeutectoid ferrite is limited. It is important for the temperature $T_1$ to be below Ac3+20° C. for the purpose of preventing excessive coarsening of the austenitic grain. Within this (Ac3-Ac3+20° C.) range, the characteristics of the final product are largely insensitive to a variation in temperature $T_1$. Very preferably, the temperature $T_1$ is between Ac3+10° C. and Ac3+20° C. Under these conditions, the inventors have demonstrated that the austenitic grain size is more homogeneous and finer, resulting thereafter in the formation of a final microstructure that itself has these characteristics;

a soak at the temperature $T_1$ for a time $t_1$ of between 50 s and 150 s. This step results in homogenization of the austenite.

The next step of the process depends on the chromium and molybdenum contents of the steel:

when the steel contains practically no chromium, molybdenum and boron, that is to say when Cr<0.005%, Mo<0.005%, B=0%, cooling at a rate $V_{R1}$ of greater than 40° C./s but below 100° C./s is carried out down to a temperature $T_2$ of between $M_s$−30° C. and $M_s$+30° C. Under these cooling rate conditions, the diffusion of carbon into the austenite is limited. This effect is saturated above 100° C./s. A soak is carried out at this temperature $T_2$ for a time $t_2$ of between 150 and 350 s. $M_s$ denotes the martensitic transformation start temperature. This temperature depends on the composition of the steel employed and may for example be determined by dilatometry. These conditions prevent the formation of proeutectoid ferrite during cooling. These conditions also result in most of the austensite being transformed to bainite. The remaining fraction is transformed to martensite or is possibly stabilized in the form of residual austenite;

when the steel has a chromium content and a molybdenum content such that Mo≤0.25%, Cr≤1.65% and Cr+3Mo≥0.3%, it is cooled at a rate $V_{R1}$ of greater than 25° C./s and less than 100° C./s down to a temperature $T_2$ of between $B_s$ and $M_s$−20° C. A soak is carried out at this temperature $T_2$ for a time $t_2$ of between 150 and 350 s. $B_s$ denotes the bainitic transformation start temperature. These conditions make it possible to obtain the same microstructural characteristics as above. The addition of chromium and/or molybdenum makes it possible in particular to ensure that no proeutectoid ferrite is formed. Within the cooling rate limits $V_{R1}$ according to the invention, the final characteristics of the product are relatively insensitive to a variation in this rate $V_{R1}$; and the next step of the process is the same whether or not the product contains chromium and/or molybdenum: a cooling step is carried out at a rate $V_R$ of less than 30° C./s down to the ambient temperature. In particular when the temperature $T_2$ is quite low within the ranges according to the invention, the cooling at a rate $V_R$ of less than 30° C./s tempers the newly formed martensite islands, this being favorable in terms of the usage properties.

EXAMPLE

Steels with the compositions given in the table below, expressed in percentages by weight, were smelted. Apart from steels I-1 to I-5 serving for the manufacture of sheets according to the invention, this table indicates the comparison between the composition of steels R-1 to R-5 serving for manufacturing reference sheets.

TABLE 1

Steel compositions (in wt %)

| Steel | C (%) | Mn (%) | Si (%) | Al (%) | Si + Al (%) | Mo (%) | Cr (%) | Cr + 3Mo (%) | S (%) | P (%) | V (%) | Ti (%) | B (%) | N (%) |
|---|---|---|---|---|---|---|---|---|---|---|---|---|---|---|
| I-1 | 0.19 | 2 | 1.5 | 0.040 | 1.54 | — | — | — | 0.003 | 0.015 | — | — | — | 0.004 |
| I-2 | 0.2 | 2 | 1.5 | 0.040 | 1.54 | 0.25 | — | 0.75 | 0.003 | 0.015 | — | — | — | 0.004 |
| I-3 | 0.19 | 2 | 1.5 | 0.040 | 1.54 | 0.25 | 0.34 | 0.76 | 0.003 | 0.015 | — | — | — | 0.004 |
| I-4 | 0.2 | 2 | 1.5 | 0.040 | 1.54 | 0.25 | — | 0.75 | 0.003 | 0.015 | — | 0.020 | 0.0038 | 0.004 |
| I-5 | 0.2 | 2 | 1.5 | 0.040 | 1.54 | 0.25 | — | 0.75 | 0.003 | 0.015 | 0.15 | 0.020 | 0.0038 | 0.004 |
| R-1 | 0.110 | 2.2 | 0.347 | 0.031 | 0.378 | 0.13 | 0.4 | 0.79 | 0.003 | 0.015 | — | 0.027 | — | 0.004 |
| R-2 | 0.038 | 0.212 | 0.036 | 0.053 | 0.089 | 1.1 | 0.21 | 3.51 | 0.003 | 0.015 | — | 0.002 | — | 0.004 |
| R-3 | 0.035 | 0.21 | 0.035 | 0.054 | 0.089 | 0.5 | 0.034 | 1.534 | 0.003 | 0.015 | — | 0.002 | — | 0.004 |
| R-4 | 0.19 | 1.3 | 0.25 | 0.040 | 0.29 | — | 0.18 | 0.18 | 0.003 | 0.015 | — | | 0.003 | 0.006 |
| R-5 | 0.148 | 1.925 | 0.214 | 0.024 | 0.238 | — | 0.19 | 0.19 | 0.002 | 0.012 | — | 0.024 | — | 0.005 |

I = according to the invention; R = reference; underlined values: not according to the invention.

Semifinished products corresponding to the above compositions were reheated to 1200° C., hot-rolled down to a thickness of 3 mm and coiled at a temperature below 550° C. The sheets were then cold-rolled down to a thickness of 0.9 mm, i.e. a reduction ratio of 70%. Starting from any one composition, certain steels were subjected to various manufacturing conditions. The references I1-a, I1-b and I1-c, I1-d denote for example four steel sheets manufactured under different conditions from the steel composition I1. Table 2 indicates the conditions for manufacturing the sheets, which were annealed after cold rolling. The heating rate $V_c$ was 10° C./s in all cases.

The Ac3, $B_s$ and $M_s$ transformation temperatures are also given in Table 2.

Also indicated are the various microstructural constituents measured by quantitative microscopy, namely fractions per unit area of bainite, martensite and residual austenite.

The M-A islands were revealed by the LePera etchant. Their morphology was examined using Scion® image analysis software.

TABLE 2

Manufacturing conditions and microstructure of the hot-rolled sheets obtained

| Steel sheet | $T_1$ (° C.) | Ac3 (° C.) | T (s) | $V_{R1}$ (° C./s) | $T_2$ (° C) | $B_s$ (° C.) | $M_s$ (° C.) | $t_2$ (° C.) | $V_{R2}$ (° C./s) |
|---|---|---|---|---|---|---|---|---|---|
| I1-a | 850 | 830 | 100 | 54 | 350 | 600 | 380 | 200 | 15 |
| I1-b | 800 | 830 | 100 | 54 | 400 | 600 | 380 | 200 | 15 |
| I1-c | 825 | 830 | 100 | 54 | 400 | 600 | 380 | 200 | 15 |
| I1-d | 850 | 830 | 100 | 54 | 450 | 600 | 380 | 200 | 15 |
| I2-a | 850 | 830 | 100 | 54 | 400 | 575 | 375 | 200 | 15 |
| I2-b | 850 | 830 | 120 | 54 | 400 | 575 | 375 | 240 | 15 |
| I2-c | 850 | 830 | 95 | 22 | 400 | 575 | 375 | 200 | 5 |
| I3-a | 850 | 830 | 100 | 54 | 400 | 565 | 395 | 200 | 15 |
| I3-b | 850 | 830 | 100 | 65 | 350 | 565 | 395 | 200 | 15 |
| I4 | 850 | 830 | 100 | 54 | 400 | 575 | 375 | 200 | 15 |
| I5 | 850 | 830 | 100 | 54 | 400 | 575 | 375 | 200 | 15 |
| Rl | 850 | 845 | 100 | 54 | 400 | 520 | 425 | 200 | 15 |
| R2 | 800 | 930 | 60 | 20 | 460 | 695 | 510 | 20 | 15 |

TABLE 2-continued

Manufacturing conditions and microstructure of the hot-rolled sheets obtained

| Steel sheet | $T_1$ (° C.) | Ac3 (° C.) | T (s) | $V_{R1}$ (° C./s) | $T_2$ (° C) | $B_s$ (° C.) | $M_s$ (° C.) | $t_2$ (° C.) | $V_{R2}$ (° C./s) |
|---|---|---|---|---|---|---|---|---|---|
| R3 | 800 | 915 | 60 | 20 | 460 | 760 | 520 | 20 | 15 |
| R4 | 850 | 845 | 300 | 20 | 460 | 650 | 425 | 20 | 15 |
| R5 | 800 | 900 | 60 | 20 | 460 | 605 | 425 | 60 | 20 |

I = according to the invention; R = reference; underlined values: not according to the invention.

The tensile mechanical properties obtained (yield strength $R_e$, strength $R_m$, uniform elongation $A_u$ and elongation at break $A_t$) are given in Table 3 below. The $R_e/R_m$ ratio is also indicated.

In certain cases, the fracture energy at −40° C. was determined on toughness specimens of the Charpy V type with a thickness reduced to 1.4 mm.

The damage associated with cutting (for example shearing or punching), which could possibly reduce the subsequent deformability of a cut part, was also evaluated. For this purpose, specimens measuring 20×80 mm$^2$ were sheared. The edges of some of these specimens were then polished. The specimens were coated with photodeposited grids and then subjected to uniaxial tension until fracture. The principal strains ε1 parallel to the stressing direction were measured as close as possible to fracture initiation from the deformed grids. This measurement was carried out on specimens having mechanically cut edges and on specimens having polished edges. The sensitivity to cutting was evaluated by the damage factor: Δ=[ε1 (cut edges)−ε1 (polished edges)]/ε1 (polished edges).

For some sheets, the damage near the cut edges on specimens measuring 105×105 mm$^2$ having a hole with an initial diameter of 10 mm was also evaluated. The relative increase in the diameter of the hole after introducing a conical punch was measured until cracking occurred.

TABLE 3

Mechanical properties of the cold-rolled and annealed sheets

| Steel sheet | Bainitic fraction (%) | (M-A) fraction (%) | (M-A) island size <1 micron and average distance <6 microns | $R_e$ (MPa) | $R_m$ (MPa) | $A_u$ (%) | $A_t$ (%) | $K_{cv}$ at −40° C. (J/cm$^2$) | Damage Δ (cut edges) (%) | Expansion (%) |
|---|---|---|---|---|---|---|---|---|---|---|
| 11-a | 89 | 11 | Yes | 718 | 1200 | 7.5 | 11.2 | 63 | | 35 |
| 11-b | 43 | 17 | No | 490 | 1020 | 15 | 19 | | | |

TABLE 3-continued

Mechanical properties of the cold-rolled and annealed sheets

| Steel sheet | Bainitic fraction (%) | (M-A) fraction (%) | (M-A) island size <1 micron and average distance <6 microns | $R_e$ (MPa) | $R_m$ (MPa) | $A_u$ (%) | $A_t$ (%) | $K_{cv}$ at −40° C. (J/cm$^2$) | Damage Δ (cut edges) (%) | Expansion (%) |
|---|---|---|---|---|---|---|---|---|---|---|
| 11-c | 63 | 17 | Yes | 500 | 1040 | 14 | 17 | 36 | | |
| I1-d | 83 | 17 | No | 550 | 1100 | 9 | 12 | | | |
| 12-a | 88 | 12 | Yes | 800 | 1250 | 8.8 | 12.7 | | −14 | |
| I2-b | 90 | 10 | Yes | 790 | 1260 | 8.2 | 12 | | | |
| 12-c | Nd | Nd | Nd | 700 | 1200 | 7 | 8.5 | | | |
| I3-a | 88 | 12 | Yes | 750 | 1200 | 9.5 | 12.7 | | | 40 |
| I-3b | Nd | Nd | Nd | 900 | 1300 | 9 | 8 | | | |
| I4 | 60 | 40 | Yes | 690 | 1420 | 8 | 11.2 | | −22.5 | |
| I5 | 45 | 55 | Nd | 800 | 1600 | 7.5 | 10 | | | |
| RI | Nd | Nd | Nd | 800 | 950 | 4 | 6 | | | |
| R2 | Ferrite | 6 | Nd | 400 | 520 | 10 | 16 | | | |
| R3 | Ferrite | 5 | Nd | 300 | 450 | 16 | 21 | | | |
| R4 | 60 | 40 | Nd | 650 | 950 | Nd | 4 | | | |
| R5 | Ferrite | 17 | Yes | 404 | 856 | 12.4 | 16 | | −43 | |

Underlined values: not according to the invention; Nd: not determined.

The sheets of composition according to the invention and manufactured according to the conditions of the invention (I1-a, I2-a-b, I3-a, I4 and I5) have a particularly advantageous combination of mechanical properties: on the one hand, a strength greater than 1200 MPa and, on the other hand, an elongation at break always greater than or equal to 10%. The steels according to the invention also have a Charpy V fraction energy at −40° C. of greater than 40 joules/cm$^2$. This allows the manufacture of parts that are resistant to the sudden propagation of a fault, especially in the case of dynamic stressing. The microstructures of the steels with a minimum strength of 1200 MPa and a minimum elongation at break of 10% according to the invention have a bainite content between 65 and 90%, the remainder consisting of M-A islands. FIG. 1 thus shows the microstructure of the steel sheet I3a comprising 88% bainite and 12% M-A islands, this microstructure being revealed by etching with the LePera etchant. FIG. 2 shows this microstructure revealed by a Nital etchant. In the case of steels having a minimum strength of 1400 MPa and a minimum elongation at break of 8%, the steels according to the invention have a bainite content of between 45 and 65%, the remainder being M-A islands. In the case of steels having a minimum strength of 1600 MPa and a minimum elongation at break of 8%, the steels according to the invention have a bainite content of between 15 and 35%, the remainder being martensite and residual austenite. The steel sheets according to the invention have an M-A island size of less than 1 micron, the inter-island distance being less than 6 microns.

The steels according to the invention also have good resistance to damage in the case of cutting, since the damage factor Δ is limited to −23%. A steel sheet (R5) not having these features may have a damage factor of 43%. The sheets according to the invention exhibit good hole expansion capability.

The steels according to the invention also have good homogeneous weldability: for welding parameters suitable for the thicknesses indicated above, the welded joints are free of cold or hot cracks.

The steel sheets I1-b and I1-c were annealed at too low a temperature $T_1$, the austenitic transformation not being complete. Consequently, the microstructure includes proeutectoid ferrite (40% in the case of I1b and 20% in the case of I1-c) and an excessive content of M-A islands. The strength is therefore reduced by the presence of proeutectoid ferrite.

In the case of steel sheet I1-d, the soak temperature $T_2$ is above $M_s$+30° C.: the bainitic transformation that occurs at a higher temperature gives rise to a coarser structure and results in an insufficient strength.

In the case of steel sheet I-2c, the cooling rate $V_{R1}$ after annealing is insufficient, the microstructure formed is more heterogeneous and the elongation at break is reduced to below 10%.

In the case of sheet I-3b, the soak temperature $T_2$ is below $M_s$−20° C. Consequently, the cooling rate $V_{R1}$ causes the appearance of bainite formed at low temperature and of martensite, these being associated with an insufficient elongation.

Steel $R_1$ has an insufficient (silicon+aluminum) content and the soak temperature $T_2$ is below $M_s$−20° C. Because of the insufficient (Si+Al) content, the quantity of M-A islands formed is insufficient to obtain a strength equal to or greater than 1200 MPa.

Steels $R_2$ and $R_3$ have insufficient carbon, manganese and silicon+aluminum contents. The amount of M-A compounds formed is less than 10%. Furthermore, the annealing temperature $T_1$ below Ac3 results in an excessive content of both proeutectoid ferrite and cementite, and leads to an insufficient strength.

Steel $R_4$ has an insufficient (Si+Al) content and the cooling rate $V_{R1}$ is in particular too low. The enrichment of the austenite with carbon upon cooling is therefore insufficient to allow the formation of martensite and to obtain the strength and elongation properties intended by the invention.

Steel $R_5$ also has an insufficient (Si+Al) content. The insufficiently rapid cooling rate after annealing results in an excessive content of proeutectoid ferrite and to an insufficient mechanical strength.

Starting from the process for manufacturing steel sheet I2-a, a steel sheet I2-d was manufactured according to a process having identical characteristics, with the exception of the temperature $T_1$, which was 830° C., i.e. the temperature Ac3. In the case in which $T_1$ is equal to Ac3, the capability of conical hole expansion is 25%. When the temperature $T_1$ is equal to 850° C. (Ac3+20° C.), the capability of expansion is increased to 31%.

Thus, the invention allows the manufacture of steel sheets that combine very high strength with high ductility. The steel sheets according to the invention are used to advantage for the manufacture of structural parts or reinforcing elements in the automotive and general industry fields.

What is claimed is:

1. A process for manufacturing a cold-rolled steel sheet with a strength greater than 1200 MPa and an elongation at break greater than 8%, in which:

providing a steel having a microstructure comprising 15 to 90% bainite, a remainder of the microstructure consisting of islands of martensite and residual austenite and a composition comprising, in weight percent:

0.10%≤C ≤0.25%;

1%≤Mn≤3%;

Al≥0.010%;

Si≤2.990%;

S≤0.015%;

P≤0.1%;

N≤0.008%;

Mo≤0.25%; and

Cr≤1.65%;

wherein 1%≤Si+Al≤3%, and Cr+3Mo≥0.3%, a remainder of the composition consisting of iron and inevitable impurities resulting from smelting; then casting a semifinished product from said steel; then heating said semifinished product to a temperature greater than 1150° C.; then hot-rolling said semifinished product so as to obtain a hot-rolled sheet; then coiling said sheet; then pickling said hot-rolled sheet; then cold-rolling said sheet with a reduction ratio of between 30 and 80% to obtain a cold-rolled sheet; and then reheating said cold-rolled sheet at a rate $V_C$ between 5 and 15° C./s up to a temperature $T_1$ between Ac3 and Ac3+20° C., and holding at said temperature $T_1$ for a time $t_1$ between 50 and 150 s, then cooling said sheet at a rate $V_{R1}$ greater than 25° C./s but below 100° C./s down to a temperature $T_2$ between $B_s$ and ($M_s$-20° C.), maintaining said sheet at said temperature $T_2$ for a time $t_2$ between 150 and 350 s, and then cooling said sheet at a rate $V_{R2}$ of less than 30° C./s down to an ambient temperature.

2. The manufacturing process of claim 1, wherein said steel further comprises, in weight percent, 0.05%≤V≤0.15%.

3. The manufacturing process of claim 1, wherein said steel further comprises, in weight percent, B≤0.005%.

4. The manufacturing process of claim 1, wherein said steel further comprises Ti in an amount so that Ti/N≥4 and Ti≤0.040%.

5. The manufacturing process of claim 1, wherein the temperature $T_1$ is between Ac3+10° C. and Ac3+20° C.

6. The manufacturing process of claim 1, wherein the steel has a microstructure comprising 45 to 65% bainite.

7. The manufacturing process of claim 1, wherein the steel has a microstructure comprising 15 to 45% bainite.

* * * * *